US007328818B2

(12) United States Patent
Prabucki

(10) Patent No.: US 7,328,818 B2
(45) Date of Patent: Feb. 12, 2008

(54) PORTABLE BOTTLED WATER DISPENSER

(76) Inventor: Robert W. Prabucki, 2209 NW. Everett St., Suite 107, Portland, OR (US) 97210

( * ) Notice: Subject to any disclaimer, the term of this patent is extended or adjusted under 35 U.S.C. 154(b) by 0 days.

(21) Appl. No.: 11/139,220

(22) Filed: May 27, 2005

(65) Prior Publication Data

US 2005/0269361 A1 Dec. 8, 2005

Related U.S. Application Data

(60) Provisional application No. 60/575,797, filed on May 29, 2004.

(51) Int. Cl.
*B67D 5/62* (2006.01)
*F25B 21/02* (2006.01)

(52) U.S. Cl. ..... 222/146.6; 222/185.1; 222/183; 62/3.64; 62/389

(58) Field of Classification Search ..... 222/146.1, 222/146.6, 185.1, 175, 131, 183, 608; 62/3.64, 62/389–400
See application file for complete search history.

(56) References Cited

U.S. PATENT DOCUMENTS 1,078,214 A * 11/1913 Patnaude ..... 62/397
1,673,007 A * 6/1928 Kaiser ..... 222/130
2,080,787 A * 5/1937 Rodgers ..... 62/306
3,170,601 A * 2/1965 Daley ..... 222/183
3,325,058 A 6/1967 West, Jr.
3,933,275 A * 1/1976 Metzner et al. ..... 222/131
4,293,082 A 10/1981 Matsueda
4,341,328 A 7/1982 Redick, Jr.
D277,255 S 1/1985 Deruntz
4,646,944 A * 3/1987 Sanderson ..... 222/108
D289,724 S 5/1987 Runyon
D292,466 S 10/1987 Runyon (Continued)

*Primary Examiner*—Kevin Shaver
*Assistant Examiner*—Stephanie E. Tyler
(74) *Attorney, Agent, or Firm*—J. Douglas Wells; Chernoff, Vilhauer, McClung & Stenzel, LLP

(57) ABSTRACT

The present invention provides a compact and short profile portable bottled beverage dispenser for gravitationally dispensing a liquid from an inverted standard sized bottle such as the 3- or 5-gallon bottles commonly used in the drinking water industry. In one embodiment, the dispenser includes a removable top made of a rigid material and closeable over a space large enough to hold and fully enclose the inverted standard sized bottle, a base having a substantially flat bottom surface for maintaining the inverted standard sized bottle in an inverted position and mating surfaces for receiving the removable top, a collar having an aperture sized to receive a neck portion of the inverted standard sized bottle and disposed within the base for supporting the inverted standard sized bottle in the inverted position, a reservoir attached to the collar for receiving the liquid from the inverted standard sized bottle, whereby the neck portion of the inverted standard sized bottle extends downward through the aperture of the collar into the reservoir, and a spigot extending from the reservoir for dispensing the liquid from the reservoir. In one embodiment, the dispenser includes shoulder straps and handles for carrying the dispenser and tie downs for securing the dispenser to an object such as a bench, chain link fence, or pickup truck bed. In another embodiment, the dispenser comprises a vehicle utility box having a space large enough to hold the inverted standard sized water bottle and a base for maintaining the inverted standard sized water bottle in an inverted position.

19 Claims, 9 Drawing Sheets

U.S. PATENT DOCUMENTS 4,823,554 A * 4/1989 Trachtenberg et al. ..... 62/3.3
4,895,418 A 1/1990 Medellin et al.
4,899,911 A 2/1990 Rohde et al.
4,928,856 A 5/1990 White
4,958,747 A 9/1990 Sheets
D313,330 S 1/1991 Brusa
4,993,229 A * 2/1991 Baus et al. ..... 62/3.64
5,072,590 A 12/1991 Burrows
5,123,720 A 6/1992 Blomster et al.
5,195,004 A 3/1993 Okuda et al.
5,246,141 A 9/1993 Burrows
5,297,700 A 3/1994 Burrows et al.
5,310,088 A 5/1994 Burrows
5,356,045 A 10/1994 Parks et al.
5,385,275 A * 1/1995 Billet ..... 222/399
5,390,826 A 2/1995 Burrows
5,395,014 A 3/1995 Burrows
5,405,052 A 4/1995 Sawyer, III
5,447,256 A 9/1995 Graham
5,449,093 A 9/1995 Burrows
5,501,077 A * 3/1996 Davis et al. ..... 62/3.64
5,553,751 A * 9/1996 Mowers ..... 222/183
5,573,142 A 11/1996 Morellato et al.
5,616,243 A 4/1997 Levy
5,638,991 A 6/1997 Todden et al.
5,647,416 A 7/1997 Desrosiers et al.
5,766,453 A 6/1998 Morellato et al.
5,842,606 A * 12/1998 DeVito ..... 222/132
5,845,504 A 12/1998 LeBleu
6,012,790 A 1/2000 Thomas et al.
6,058,718 A 5/2000 Forsberg et al.
6,073,539 A 6/2000 Triola et al.
6,155,460 A 12/2000 Lee
6,182,453 B1 2/2001 Forsberg
6,269,980 B1 * 8/2001 Randall et al. ..... 222/145.5
6,616,013 B2 9/2003 Tansley et al.
6,648,184 B1 11/2003 Williams et al.
6,675,593 B1 1/2004 Suydam et al.
6,783,034 B1 8/2004 Brent
6,786,255 B1 9/2004 Lee
6,793,099 B1 9/2004 Sleiman
6,830,167 B2 * 12/2004 Schomaker ..... 224/404
6,868,986 B1 3/2005 Arnold
6,871,675 B1 3/2005 Marszalec et al.

* cited by examiner

PORTABLE BOTTLED WATER DISPENSER

CROSS-REFERENCE TO RELATED APPLICATIONS

This application claims the benefit of U.S. provisional application Ser. No. 60/575,797, filed May 29, 2004, having the same title as the present application. The specification of the above provisional application is incorporated in its entirety herein by reference.

BACKGROUND OF THE INVENTION

The technical field of invention relates to devices for dispensing bottled drinking water. More particularly, the present invention pertains to devices and methods for dispensing drinking water using standard sized bottled drinking water.

The design of most commonly available water dispensers includes a receiving device for gravitationally a holding three- or five-gallon bottle of drinking water, a small reservoir through which the drinking water passes and in which the water is either heated or chilled by active components (heating and/or cooling coils), a spigot for dispensing the water, and a vertical cabinet containing the aforementioned components plus associated compressors and related components. Most of the dispensers currently available are floor models, although tabletop or countertop units have recently been produced.

All of these prior designed water dispensers are suitable only for stationary or static location applications and are not suitable for truly portable use. None of the currently available dispensers can be transported as one would transport a typical cylindrical style cooler/container, and none are suitably configured or appropriately integrated into the design of vehicle utility compartments or toolboxes such as the toolboxes currently available for use with pickup trucks.

Instead of using bottled water dispensers, contractors, road construction crews, and others routinely needing a source of drinking water at a job site are currently using the cylindrical type coolers/containers strapped to their truck utility box or simply thrown in the back of such vehicles used at job sites. The water dispensed by such containers is typically not cooled except for perhaps an initial quantity of ice that is mixed into the water to be dispensed or additional ice periodically added to the water to be dispensed.

Consequently, the water to be dispensed by such containers is typically mixed in with the cooling ice and easily becomes tainted by any flavors or impurities contained in the ice. The water may become contaminated by dirty ice, handled ice, and so forth. Further, the container may become contaminated over time since water is typically added to such containers using available water supplies, commonly a garden hose or available bucket, which may themselves be contaminated.

In addition to frequently unsanitary methods of refilling these water coolers/containers (at job sites), a substantial number of coolers used at job sites are simply not cleaned in a manner or frequency capable of ensuring a reasonable level of sanitation. More often than not, job site coolers that have become fouled are simply rinsed out with water and refilled with water from a garden hose or bucket. As a result, these job site water containers remain unsanitary and provide convenient breeding grounds for harmful bacteria, viruses, and diseases.

The health hazards of unsanitary drinking water are apparent. At job sites, productivity may be adversely affected by workers sickened or made ill due to unsanitary drinking water. Job site foremen have complained of workers becoming sick during the work day potentially due to unsanitary drinking water, a lack of available clean drinking water, and so on. Job site workers have expressed a need for clean drinking water at job sites and for water that is cooled.

What is needed, therefore, is a different style of water dispenser. What is needed is an improved drinking water dispenser with improved sanitation.

The foregoing and other objectives, features, and advantages of the invention will be more readily understood upon consideration of the following detailed description of the invention taken in conjunction with the accompanying drawings.

BRIEF DESCRIPTION OF THE SEVERAL DRAWINGS

For a more complete understanding of the present invention, the drawings herein illustrate examples of the invention. The drawings, however, do not limit the scope of the invention. Similar references in the drawings indicate similar elements.

Figure 8A:
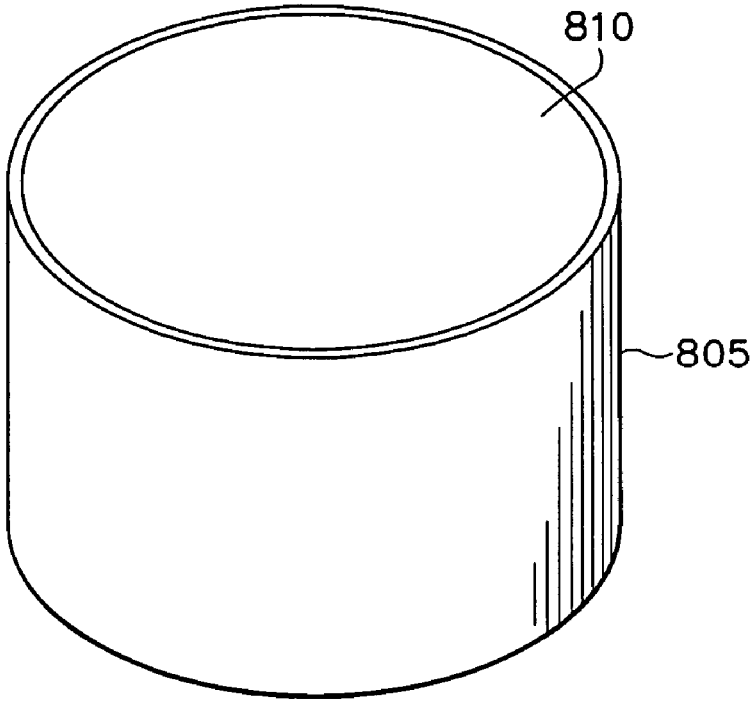
Figure 8B:
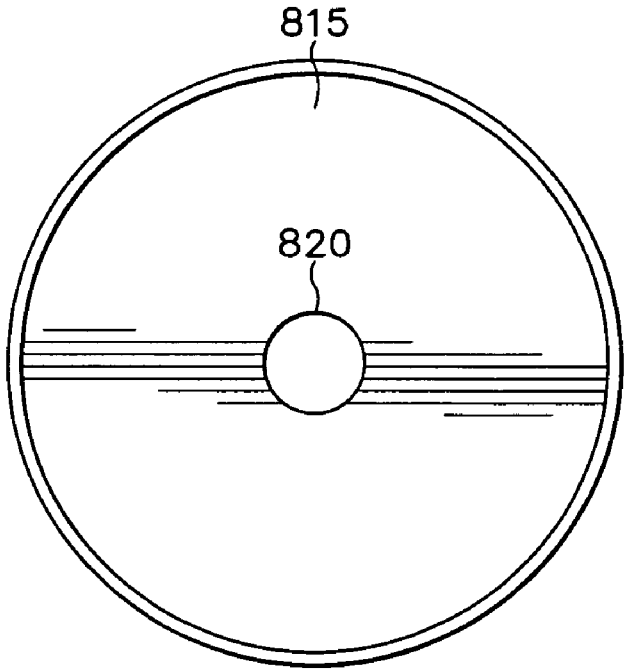

FIGS. 8*a* and 8*b* illustrate an exemplary reservoir for use with a portable bottled water dispenser according to one embodiment of the invention.

Figure 9:
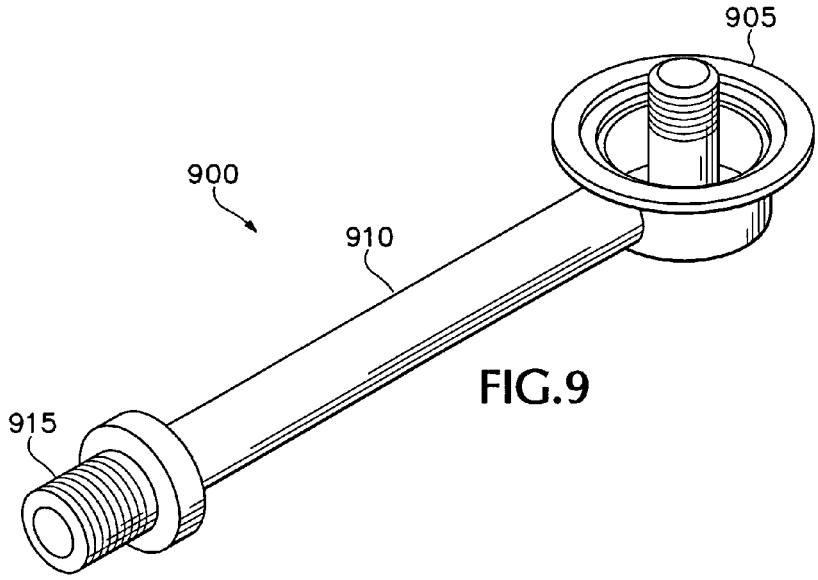

FIG. 9 illustrates an exemplary drain tube for use with a portable bottled water dispenser according to one embodiment of the invention.

Figure 10:
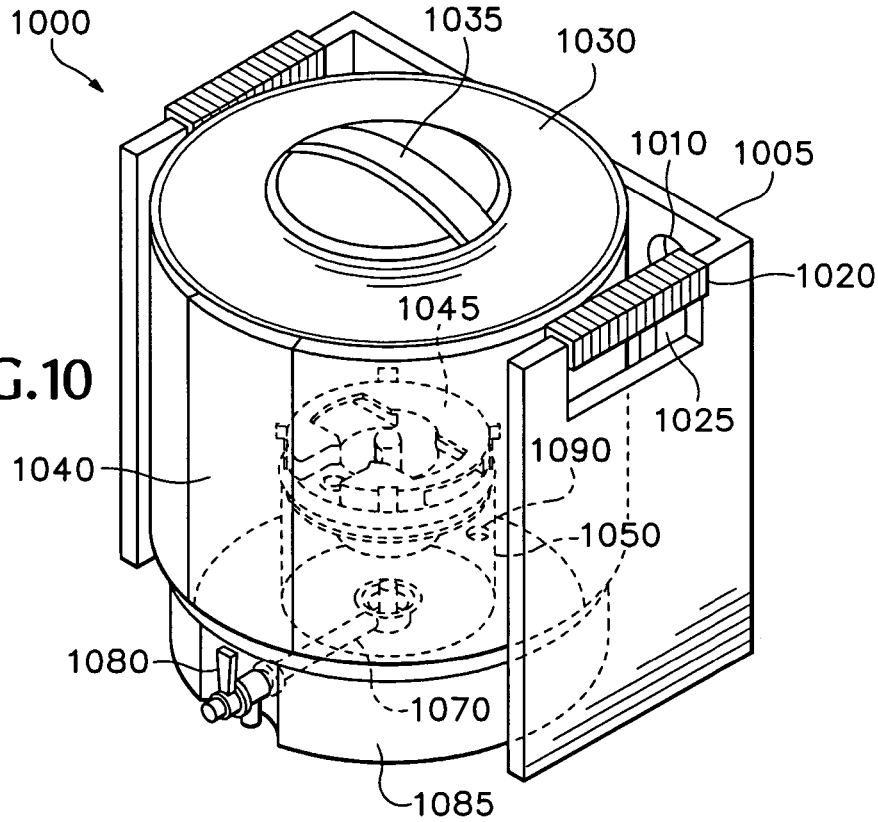

FIG. 10 illustrates an isometric transparent view of a portable bottled water dispenser with carrying frame, according to one embodiment of the invention.

Figure 11:
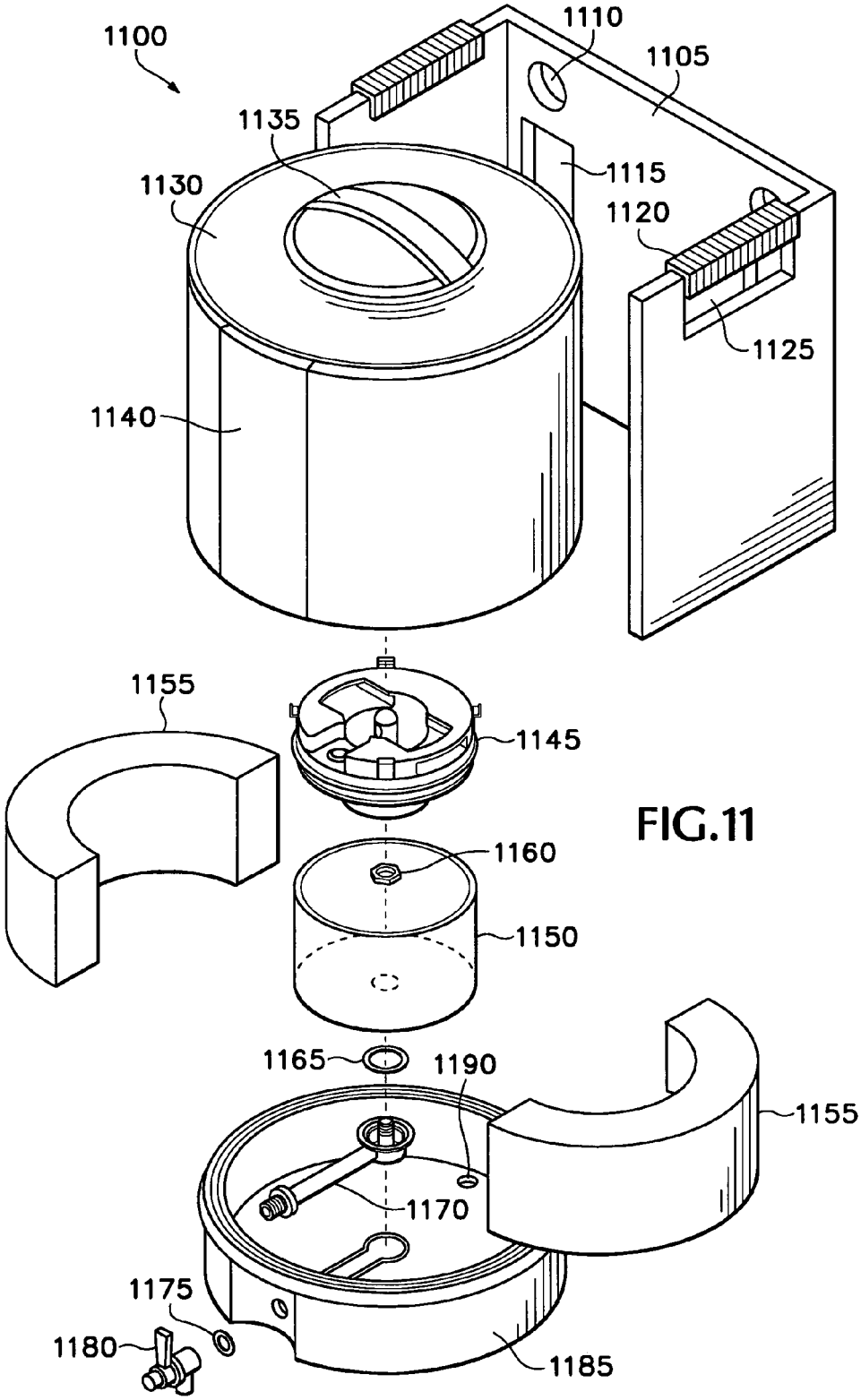

FIG. 11 illustrates an exploded view of the portable bottled water dispenser with shoulder straps shown in FIG. 10.

Figure 12:
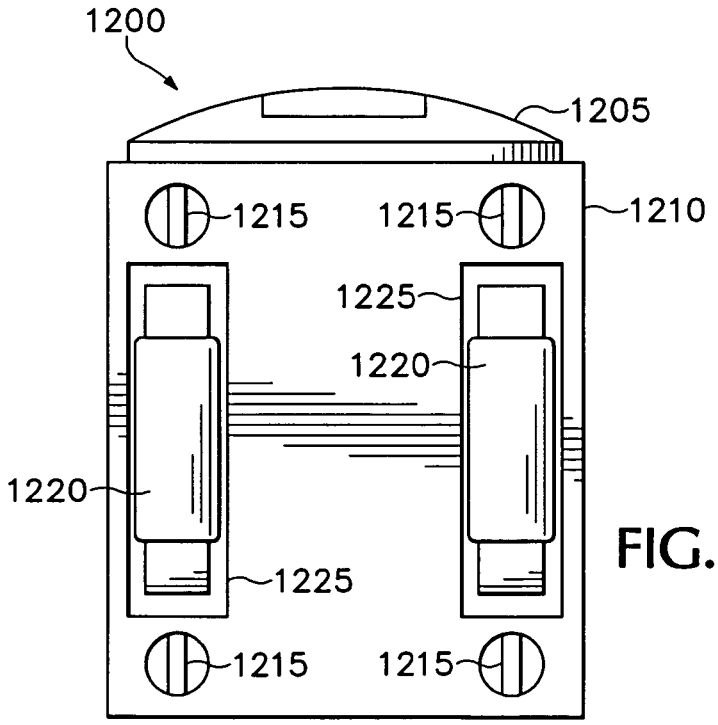

FIG. 12 illustrates a rearward view of a portable bottled water dispenser with an exemplary carrying frame, according to one embodiment of the invention.

DETAILED DESCRIPTION OF PREFERRED EMBODIMENTS

In the following detailed description, numerous specific details are set forth in order to provide a thorough understanding of the present invention. However, those skilled in the art will understand that the present invention may be practiced without these specific details, that the present invention is not limited to the depicted embodiments, and that the present invention may be practiced in a variety of alternate embodiments. In other instances, well known methods, procedures, components, and systems have not been described in detail.

Various operations will be described as multiple discrete steps performed in turn in a manner that is helpful for understanding the present invention. However, the order of description should not be construed as to imply that these operations are necessarily performed in the order they are presented, nor even order dependent.

In various embodiments, the present invention pertains to a portable apparatus for cooling and/or dispensing water using standard three- or five-gallon bottled drinking water, an apparatus for cooling and/or dispensing water using standard three- or five-gallon bottled drinking water integrated into a pickup or vehicle toolbox, an apparatus for actively chilling or heating water dispensed from standard three- or five-gallon bottled drinking water, other embodiments incorporating a compact or short profile dispensing device for receiving drinking water from three- or five-gallon bottled drinking water, and the methods associated with these devices. In various embodiments, the apparatus comprises a container for enclosing a standard sized bottle, a collar for supporting the bottle, a reservoir for receiving liquid from the bottle, and a spigot for dispensing the liquid from the reservoir.

The present invention, in one embodiment, comprises using standard three- or five-gallon bottled drinking water with the standardized dispenser caps, a collar for supporting the bottle, a reservoir for receiving water from the bottle, a spigot for dispensing the water from the reservoir, and space around the reservoir that may be filled with ice to cool the water in the reservoir. In one embodiment, the present invention comprises using standard three- or five-gallon bottled drinking water with the standardized dispenser caps, a collar for supporting the bottle, a reservoir for receiving water from the bottle, a spigot for dispensing the water from the reservoir, and elements thermally contacting the reservoir to heat or chill the water contained therein.

Figure 1:
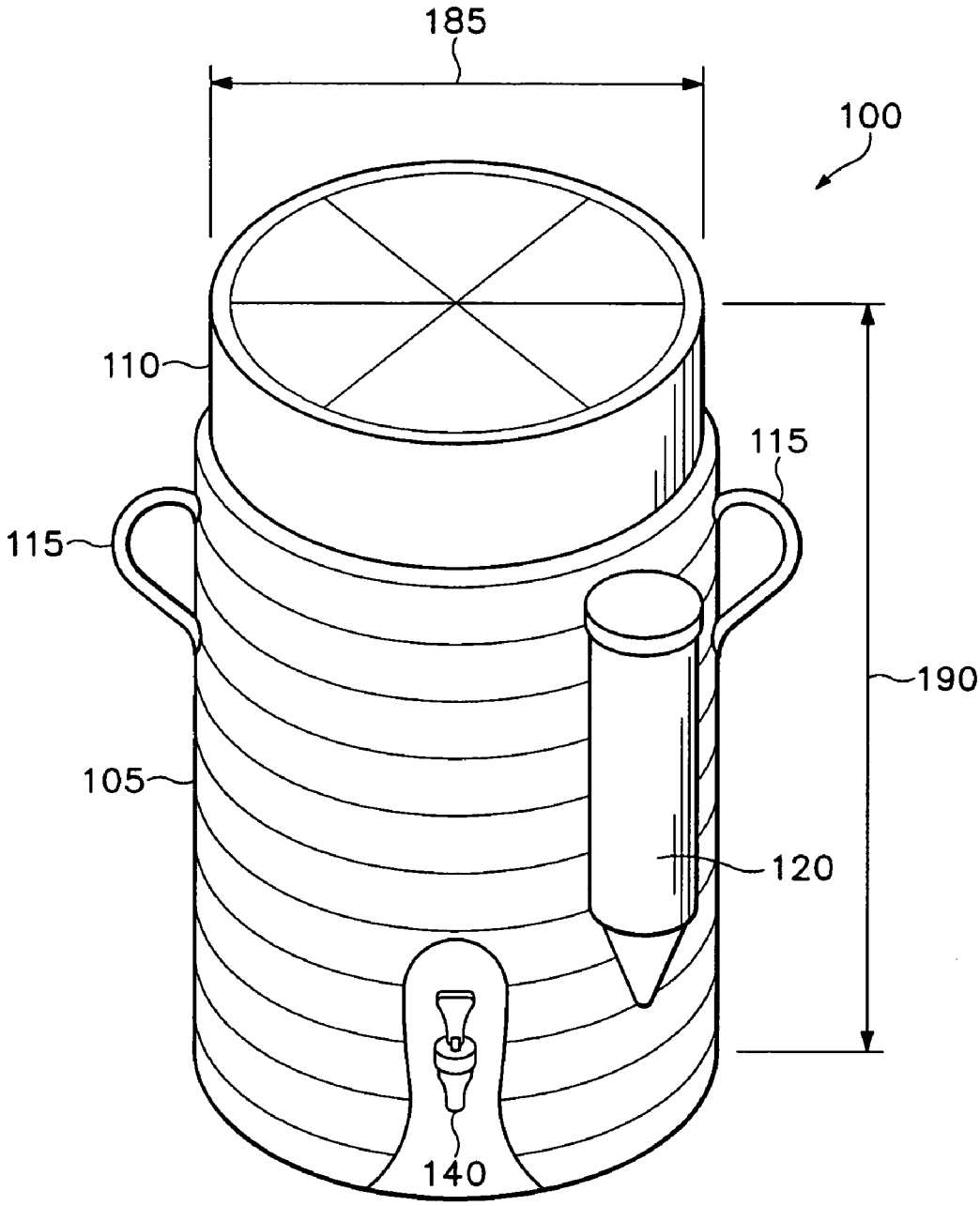
FIG. 1 illustrates a portable bottled water dispenser according to one embodiment of the invention.

In one embodiment, and illustrated in FIG. 1, the complete portable bottled water dispenser comprises an appropriately sized cylindrical cooler configuration that may be portably used just as other currently available cylindrical type coolers may be portably used. That is, in one embodiment, the present invention comprises a substitute for the currently available cylindrical type beverage coolers whereby sanitary bottled water (or another beverage) is dispensed instead of water (or another beverage) that is in direct contact with the interior surfaces of the cylindrical type cooler. The portable bottled water dispenser 100 may comprise, according to one embodiment of the invention, a cylindrically shaped container 105 within which standard sized water bottle (filled with water or another beverage) may be contained, a circular lid 110 that closeably mates with the container 105, and handles 115 for lifting the dispenser 100. The dispenser 100 may include a cup dispenser 120 from which cups may be dispensed for use with water or another beverage dispensed from the spigot 140. As shown in FIG. 1, in one embodiment, the dispenser may have a diameter 185 of approximately 13 inches and a height 190 of approximately 19 inches. These dimensions may vary considerably and are preferably optimally chosen to handle standard sized bottled water and to allow for a compact and short profile for the dispenser 100. For instance, a dispenser 100 with a diameter 185 of roughly 13 inches and a height 190 of roughly 19 inches may be most suitable for a dispenser 100 using standard 3-gallon sized drinking water bottles. Smaller dimensions may be used for a dispenser 100 that uses smaller bottles such as standard 2-gallon bottles. Larger dimensions may be used for a dispenser 100 that uses larger bottles such as 5-gallon or 6-gallon bottles.

As mentioned, a beverage other than water may be dispensed. For example, the standard sized bottle may be filled with a sports drink such as Gatorade® or any other liquid.

The present invention preferably uses standard sized bottles commonly used in the drinking water industry. Such standard sized bottles have a substantially cylindrical shape with a neck that may be placed within a receiving collar for supporting the bottle in an upside down (inverted) orientation for gravitationally dispensing the fluid contents of the bottle from the neck of the bottle directed downward. The standard sized bottles may be similar to a five-gallon water bottle produced by Reid Canada, Inc., sold under the name Aqualite® Bottle, and marked with U.S. des. Pat. No. D339,067 (by Rokus, issued Sep. 7, 1993), which is incorporated in its entirety herein by reference. Several different bottle designs are available which use standard neck and overall diameter dimensions. Most are available in three- or five-gallon sizes. However, two-, four-, and six-gallon sizes may also be used as may be other sizes that preferably comprise standardized dimensions for use with existing floor standing type drinking water dispensers.

Figure 2:
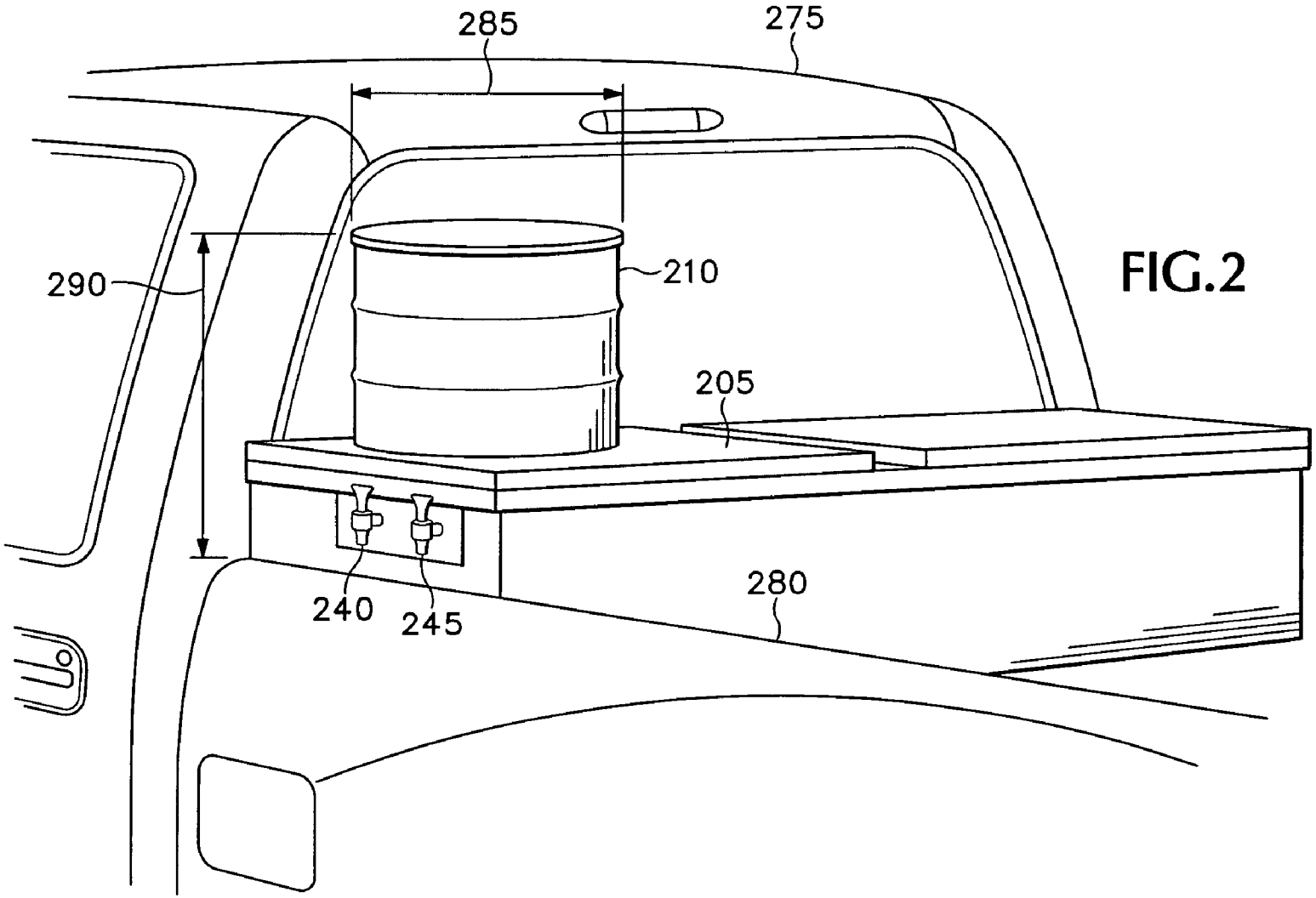
FIG. 2 illustrates a portable bottled water dispenser integrated into a vehicle toolbox, according to one embodiment of the invention.

In another embodiment, and illustrated in FIG. 2, the complete portable bottled water dispenser comprises a dispenser integrated within a vehicle utility box or pickup toolbox. The toolbox mounted dispenser offers contractors, construction workers, or any job site application a convenient source of sanitary drinking water. As shown in FIG. 2, in one embodiment, the dispenser may be mounted within a truck toolbox 205. In this configuration, a lid 210 may cover the standard sized bottled water thereunder. The lid 210 may function to retain or immobilize the bottled water, insulate the bottled water from temperature changes, or shield the bottled water from environmental conditions such as direct sunshine, exposure to dirt or debris, and so on. Spigots 240 and 245 may comprise hot and cold spigots, respectively, and may be located on the sidewalls of the toolbox 205 within the pickup bed of truck 275 so that the spigots are accessible above the sides 280 of the pickup bed. As shown in FIG. 2, in one embodiment, the toolbox mounted dispenser may have a lid diameter 285 of approximately 13 inches and a height 190 (measured from the top edge of sides 280 to the top of lid 210) of approximately 22 inches. These dimensions may vary considerably and are preferably optimally chosen to handle standard sized bottled water.

As will be appreciated, the apparatus may be installed differently within the toolbox shown in FIG. 2. For example, the dispenser may be installed on the opposite side of the toolbox or in the middle, or elsewhere. Indeed, the present invention is not limited to integration within a toolbox as shown in FIG. 2. The apparatus may be integrated into any vehicle utility space. In one embodiment, the dispenser apparatus may be integrated into the rear truck bed compartments of a vehicle such as a telephone repair vehicle or other similar utility vehicle.

An alternate embodiment may comprise the components of the toolbox dispenser as shown in FIG. 2 without a lid 210. That is, in one embodiment, the toolbox may be configured with an appropriately sized hole within the top surface of the toolbox 205, sized for receiving a standard sized bottle (such as a 3- or 5-gallon bottle), as well as spigots 240 and 245 and other associated components associated with the dispenser (not shown). In this configuration, the inverted standard sized water bottle (as received by the tool box dispenser unit) is exposed above the surface of the toolbox 205. Such a configuration may be preferable in job site situations involving frequent water bottle changes (high water usage), active systems within the toolbox 205 for chilling or heating the water (or beverage) to be dispensed, or other circumstances reducing the benefits of having a lid 210.

Figure 3:
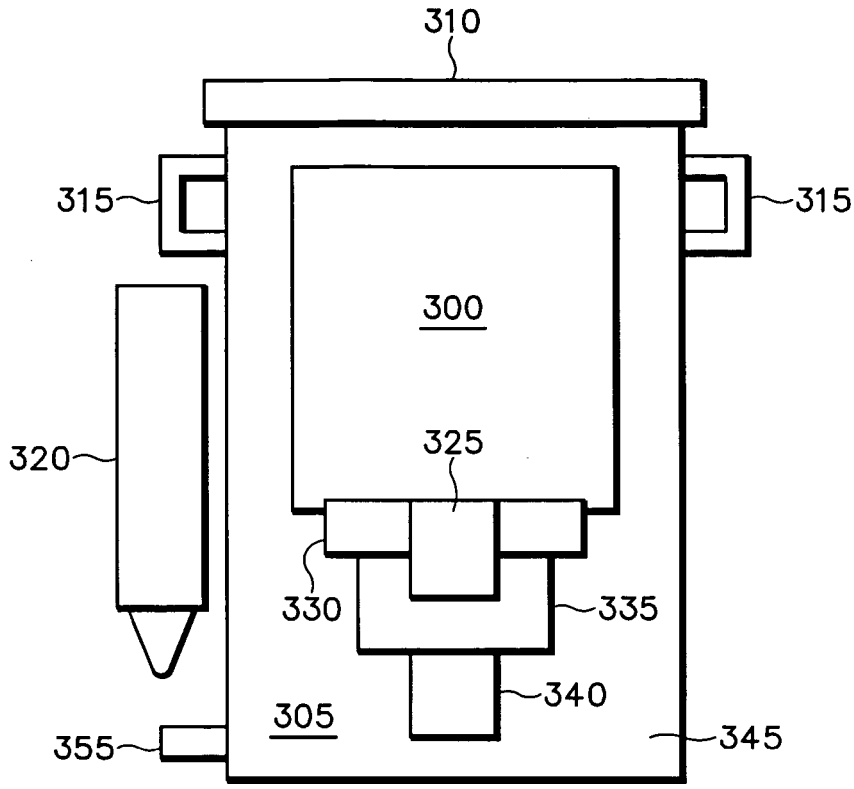
FIG. 3 illustrates a sectional view of a portable bottled water dispenser according to one embodiment of the invention.

FIG. 3 is intended to show the present invention, in one embodiment, in functional detail. In one embodiment, the present invention comprises a drinking water cooler that looks very similar to common cylindrical type coolers except that the cooler dispenses bottled drinking water instead of water held directly within the interior compartment of the cooler. As shown in FIG. 3, a container 305 with drain plug 355 and lid 310 is provided. In one embodiment, the container 305 is made of an insulated plastic, similar to the materials used for food or beverage coolers (such as currently produced cylindrical type coolers). A variety of materials may be chosen. Handles 315 may be provided to assist with portability. In one embodiment, a cup dispenser 320 may be provided.

In one embodiment, a three-gallon standard water bottle 300 commonly supplied to offices and the like may be fully enclosed within the container 305 and lid 310, as shown in FIG. 3. The container 305 and/or lid 310 may comprise an insulated construction for managing the temperature within the contained space (within which the bottle 300 may be contained). Preferably, the material enclosing the space for a standard sized bottle comprises a rigid opaque material. In one embodiment, the enclosing material is rigid opaque molded plastic.

In one embodiment, a five-gallon bottle 300 may be used. In one embodiment, the present invention comprises a three-gallon bottle 300 with the aforementioned container 305 and supported by a collar configuration comprising the standard bottled water dispenser interface 330. This interface (or collar supporting bottle) 330 is used throughout the bottled water industry and is well known to those skilled in the art. The collar support structure, as shown, supports the bottle 300 (receiving the neck of the water bottle 325) and mates with a reservoir 335, and the reservoir 335 gravitationally feeds the drinking water through a spigot 340 for dispensing water (or another beverage) to a consumer. The neck of the water bottle 325 preferably extends downward through the aperture (or center hole) of the collar 330 and into the interior (liquid holding) space of the reservoir 335. A variety of materials may be used for these components. In one embodiment, the reservoir 335 comprises a metallic bowl shaped or cylindrically shaped chamber. In one embodiment, the reservoir 335 comprises a stainless steel water holding chamber. A metallic construction for the reservoir 335 is used to enhance the heat transfer from the water to the cooling ice or other ice substitute that may be filled into the space 345 around the reservoir and bottle of water 300, in one embodiment.

In one embodiment, the space (or cavity) around the bottle 300, supporting collar 330, reservoir 335, and spigot 340 connections may be filled with ice, ice packs, or some other coolant. In one embodiment, a reusable coolant material may be used instead of ice. In one embodiment, a freezable gel (sometimes called blue ice) comprises the coolant material and may be inserted into the space between the interior container wall and the exterior of the bottle 300, collar 330, reservoir 335, and so forth.

In one embodiment, the reservoir 335 comprises a cylindrical chamber thermally coupled with a circumferentially shaped space for ice or another coolant, the circumferentially shaped space forming a circular trough within which coolant material such as ice and through which heat is transferred from the water in the reservoir 335 to the coolant material surrounding the reservoir and thermally in contact with this circular trough. In one embodiment, the circular trough comprises a metallic construction. In one embodiment, the circular trough comprises the lower portion of the interior surfaces of the container. In one embodiment, the circular trough comprises larger portions of the interior surfaces of the container containing the three- or five-gallon standard bottles, the larger size improving the heat transfer from the drinking water to the coolant material in the space between the container interior surfaces and the bottle/collar/reservoir exterior surfaces.

Figure 4:
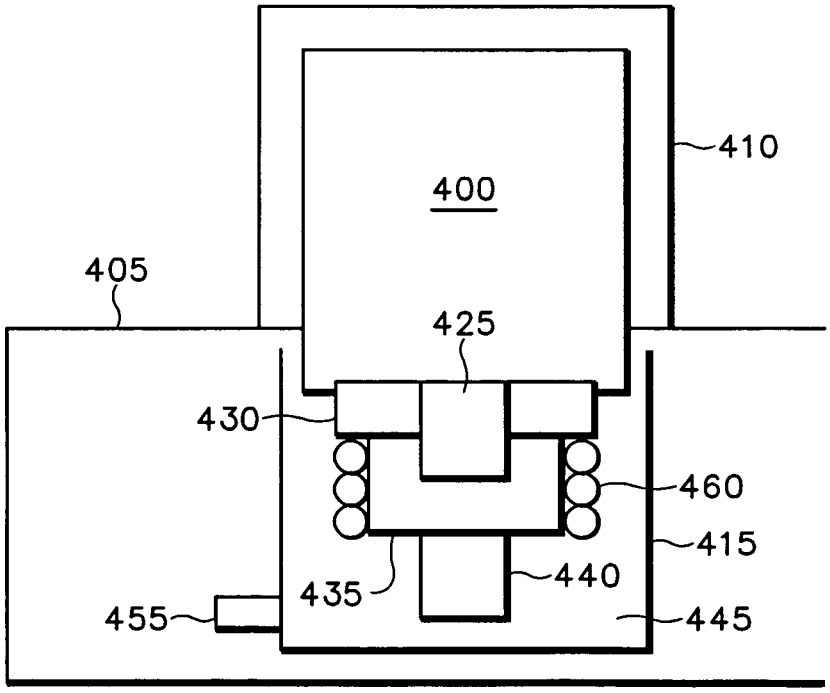
FIG. 4 illustrates a sectional view of a portable bottled water dispenser integrated into a vehicle toolbox, according to one embodiment of the invention.

FIG. 4 illustrates the present invention, according to one embodiment, comprising a bottled water dispenser integrated into a truck bed toolbox 405. As shown, in one embodiment, a lid 410 may be used to cover the exposed portion of the three- or five-gallon standard sized water bottle 400. The lid 400 may function to keep the water out of direct sunlight and thereby helps to keep the water from heating up. The lid may also function to retain or immobilize the bottle. In one embodiment, the bottle 400 (and its neck structure 425) are supported by a collar 430 and so on as in FIG. 3. In one embodiment, a lower container portion 415 is used to contain the collar 430, reservoir 435, spigot 440, and so forth, and provides space 445 for ice or another coolant material. A drain 455 may be provided for draining the melted ice.

Also shown in FIG. 4, cooling and/or heating elements 460 may be suitably positioned about the reservoir 435, in one embodiment, so as to provide a heating and/or cooling capability. The elements or coils 460 may be made of a wide variety of materials. As will be appreciated, the elements 460 may be disposed on the surface of the reservoir 435 in a variety of ways or even integrated into the reservoir structure itself. Associated compressors, pumps, element linkages, temperature controls, power supply considerations, and so forth are not shown as they are well known or may be suitably designed using a wide variety of commercially available components. Such components may be disposed anywhere within the truck bed toolbox 405 or anywhere on the vehicle hosting the toolbox 405.

In one embodiment, the elements 460 may comprise Peltier or other types of thermoelectric elements theremally coupled with the reservoir 435 and/or linkages to the spigot 440 for cooling or heating of the fluids therein. Any of a wide variety of available Peltier or other types of thermoelectric elements may be used. As is well known, Peltier elements convert a voltage difference into a temperature gradient within a material substrate and are frequently used for cooling PC components, especially overdriven or modified computer processors. Typical Peltier elements cool on one side and heat on the other. Incorporation of thermoelectric elements within the space 445, in one embodiment, provides cooling or heating of the fluid to be dispensed depending upon the polarity of the voltage applied to and the configuration of the thermoelectric elements. In one embodiment, the elements 460 may comprise thermoelectric elements configured to cool the reservoir 435 and utilize the space 445 for dissipating the heat generated by the elements 460. The space 445 may include air ways for dissipating heat generated by the elements 460. One or more fan (not shown) may be included to increase the volume of air available for dissipating heat generated by the elements 460.

Referring back to FIG. 3, in one embodiment, active elements such as elements 460 may be included within the space 345 as described and illustrated in FIG. 4. That is, although the dispenser illustrated in FIG. 3 is preferably a passive device whereby the fluid to be dispensed is cooled by ice or other passive means, the dispenser illustrated in FIG. 3 may be configured in similar fashion as the dispenser illustrated in FIG. 4 with active means for cooling (or heating) the fluid to be dispensed.

Figure 5:
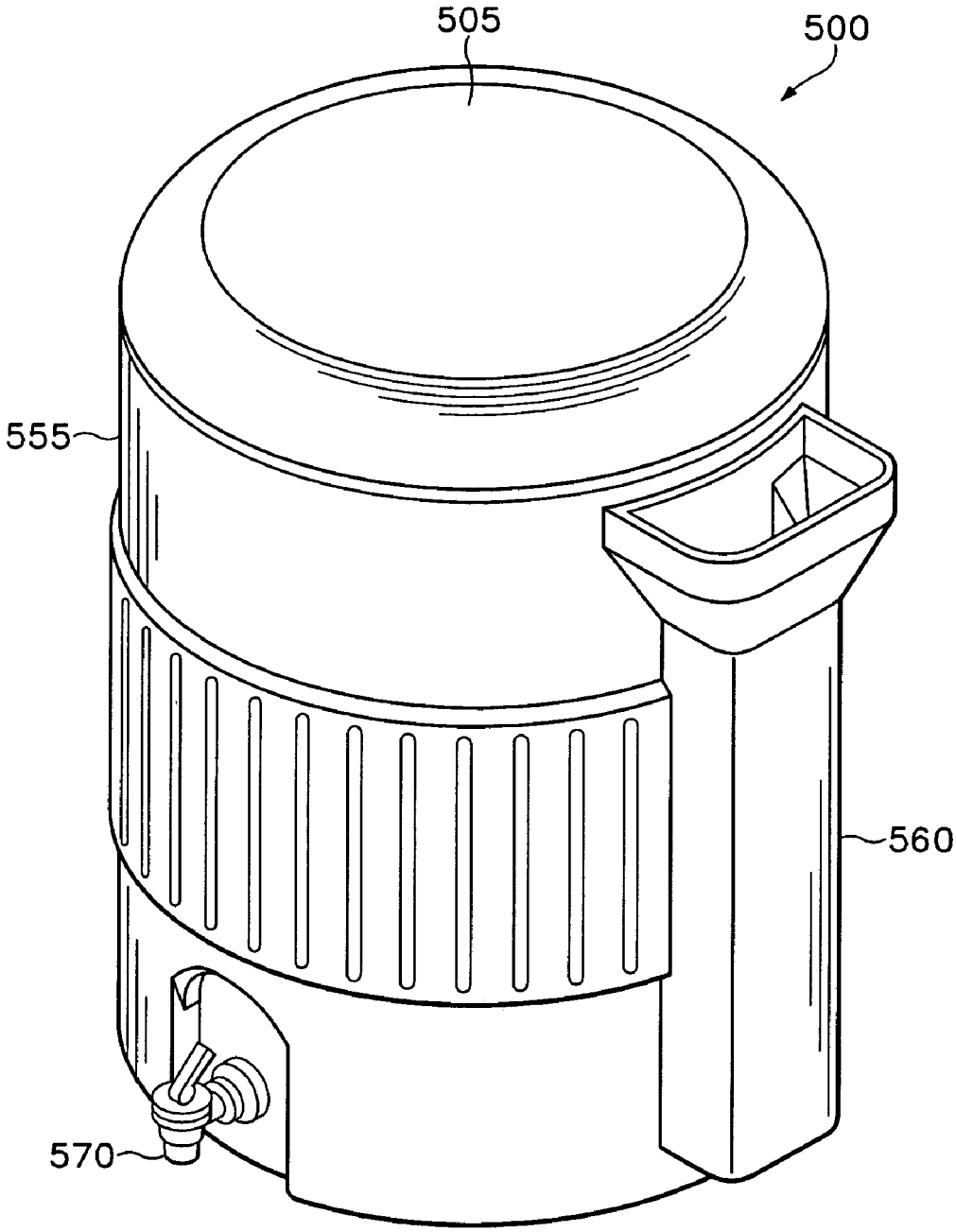
FIG. 5 illustrates an isometric view of a portable bottled water dispenser with an ice loading chute, according to one embodiment of the invention.

Moving on, FIG. 5 illustrates an isometric view of a portable bottled water dispenser 500 with an ice loading chute 560, according to one embodiment of the invention. As shown, the portable bottled water dispenser 500 comprises a lid 505 for covering a cylindrical container 555 having an ice loading chute 560 and a dispensing spigot 570. Once a standard sized bottled is placed within the container 555, it may be difficult to add ice into the container 555 for cooling the fluid to be dispensed. The chute 560 provides access to the lower portion of the dispenser 500 where the reservoir is located and whereby the fluid to be dispensed may be most effectively cooled. In one embodiment, ice may be inserted at the top end of the chute 560 (near the lid 505). Ice may then pass from the chute 560 into the container 555 through one or more holes between the chute 560 and the container 555.

Figure 6:
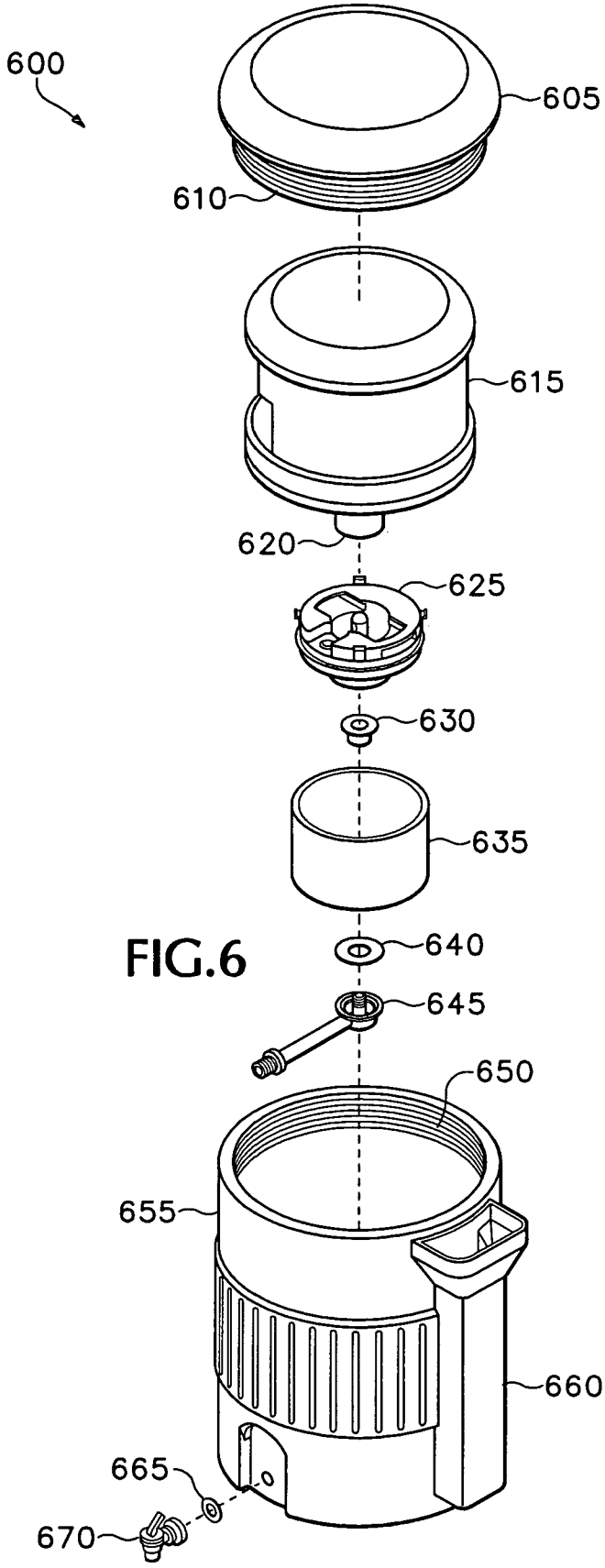
FIG. 6 illustrates an exploded view of the portable bottled water dispenser shown in FIG. 5.

Next, FIG. 6 illustrates an exploded view of the portable bottled water dispenser shown in FIG. 5. As shown, the portable bottled water dispenser 600 may include an ice cube chute 660. The portable bottled water dispenser 600 may comprise a lid 605 with threads 610 for engaging with mating threads 650 on a cylindrical container 655. Alternatively, the lid 605 may include an interference fit surface 610 suitably designed to fit snugly and retainably with a mating interference fit surface 650 disposed upon the container 655.

Within the container 655, a standard sized bottled 615 with neck 620 gravitationally rests upon a supporting collar 625 (sometimes called a water guard). As shown, the water guard 625 fits into a reservoir 625 and connects with a fluid dispensing tube 645 which is sealed to the reservoir 625 with a tube gasket 640 and a tube connection nut 630. The fluid dispensing tube 645 protrudes through the lower portion of the container 555 and a sealing washer 665 before connecting with a spigot 670. When the spigot 670 is opened water or fluid within the bottle 615 is permitted to flow downward through the water guard 625 and into the reservoir 615 and water dispensing tube 645 and out the spigot 670.

Figure 7:
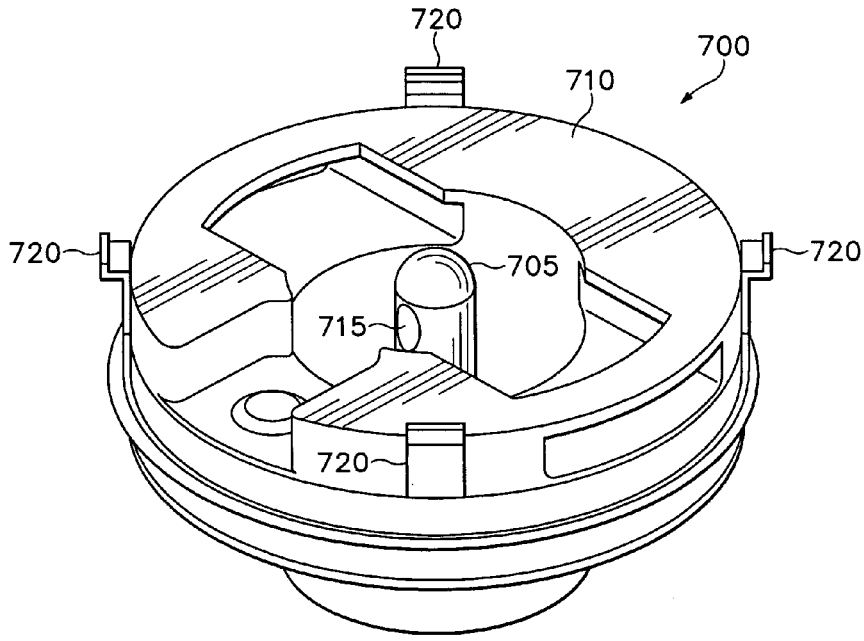
FIG. 7 illustrates an exemplary water guard for use with a portable bottled water dispenser according to one embodiment of the invention.

FIG. 7 illustrates an exemplary water guard 700 for use with a portable bottled water dispenser according to one embodiment of the invention. The water guard 700 shown is representative of water guards commonly used with standard sized bottled water. A stem 705 penetrates the neck of the standard sized bottle when the bottle is lowered down over and into the water guard 700. A bearing surface 710 supports the bottle (as may other portions of the water guard 700). Water or fluid from within the bottle may flow through the inlet 715 to fill the reservoir. Retaining clips 720 may be used to retain the water guard 700 within the reservoir, preventing the water guard 700 from slipping into the reservoir more than necessary to engage a connection seal 725 for sealing the water guard 700 and the inside surface of the reservoir.

Other styles of water guards or supporting collars may be used. For example, the supporting collar 700 may exclude the stem 705. The supporting collar 700 may include a bearing surface 710, retaining clips 720, a connection seal 725, and an inlet disposed at the lowest portion of the supporting collar 700 and aligned with the center of the portion formed for receiving the neck of a standard sized water bottle.

FIGS. 8*a* and 8*b* illustrate an exemplary reservoir for use with a portable bottled water dispenser according to one embodiment of the invention. The reservoir may comprise any of a wide variety of materials, shapes, and sizes. The reservoir, in one embodiment, preferably comprises a cylindrical shape with exterior sides 805, an interior 810, a bottom surface 815, and a drain hole 820.

The reservoir is preferably made of a metallic material that is thermally conductive so that the interior of the reservoir may be cooled more effectively. For instance, ice or another coolant in contact with the exterior sides 805 will more effectively draw heat out of fluid within the interior 810 if the reservoir is made of a thermally conductive material. Cooling (or heating) elements may be positioned around the exterior sides 805 or bottom surface 815.

FIG. 9 illustrates an exemplary drain tube 900 for use with a portable bottled water dispenser according to one embodiment of the invention. As shown, the drain tube 900 includes an attachment end 905 for fluidly connecting the drain tube 900 to a reservoir such as the reservoir shown in FIGS. 8*a* and 8*b*, a tube 910, and a spigot connection 915 for fluidly connecting the drain tube 900 with a spigot such as the spigot 670 shown in FIG. 6. The drain tube 900 may be used for delivering fluid from a reservoir to a dispensing spigot and may comprise any of a wide variety of materials. In one embodiment, the drain tube 900 comprises a plastic material. In another embodiment, the drain tube 900 comprises a thermally conductive material such as a metallic material so that ice or other coolants may draw heat from the fluid within the drain tube 900 thereby cooling the fluid to be dispensed. Although not shown, active cooling (or heating) elements may be disposed on the drain tube 900 to cool (or heat) the fluid within the drain tube 900.

Next, FIG. 10 illustrates an isometric transparent view of a portable bottled water dispenser 1000 with carrying frame 1005, according to one embodiment of the invention. As shown, the portable bottled water dispenser 1000 comprises a carrying frame 1005 with recessed tie down holes 1010 for attaching the carrying frame 1005 to a removable cooler top 1040 and a cooler base 1085. Preferably, the dispenser 1000 comprises a carrying frame 1005 with recessed tie down features 1010 for attaching the dispenser 1000 to various structures. Such structures may include, but are not limited to, a motor vehicle (such as a pickup bed), a chain link fence or bench (perhaps at a sporting event), or any desired structure.

The carrying frame 1005 may include handles 1020 with handle reliefs 1025. The removable cooler top 1040 may include an integral lid 1030 with lid handle 1035. In one embodiment, the removable cooler top 1040 and the integral lid 1030 together form an integrated top. The removable cooler top 1040 may substantially cover the standard sized water bottle space within the portable bottled water dispenser 1000. The removable cooler top 1040 may cover 90% of the height of the standard sized bottle (or 80%, 70%, 60%, 50%, 40%, 30%, and so on). Preferably, the removable cover top 1040 covers over 50% of the height of the standard (3- or 5-gallon) sized water bottle so as to permit easy replacement of the bottle.

The removable cooler top 1040 may be securely fastened to the cooler base 1085 using a strap, latch, lock, or other mechanism. Such a securing mechanism preferably holds the standard sized bottle firmly to the receptacle or water guard so as to minimize leakage when the dispenser 1000 is moved. As will be appreciated, such a securing mechanism may be used with any of the embodiments described herein. For instance, the dispenser mounted within a truck toolbox as in FIG. 2 preferably uses a securing mechanism to minimize leakage when the truck carrying the dispenser is moved.

Also shown in FIG. 10, are various components such as a water guard 1045, a reservoir 1050, a water dispensing tube 1070, a spigot 1080, and a waste drain 1090. Although the footprint of the portable water dispenser 1000 is illustrated as circular (defined by the cylindrical removable top cover 1040 and cooler base 1085) with a rectangular carrying frame 1005, the footprint may comprise a semi-circular, semi-rectangular outline defined by a cooler base 1085 that is semi-circular on one side (a front side) and rectangular on the other side (a back side). That is, the cooler base 1085, in one embodiment, may be non-cylindrical to better mate with a substantially rectangular carrying frame 1005. Furthermore, although various components appear to be distinct and separate, components may be combined where manufacturing processes allow. For instance, the removable cooler top 1040 and the integral lid 1030 may comprise a single molded piece. Likewise, the cooler base 1085 and the carrying frame 1005 may comprise a single molded component. Other combinations may be made without altering the intended scope of the invention described herein.

FIG. 11 illustrates an exploded view of the portable bottled water dispenser with shoulder straps shown in FIG. 10. As shown, a portable bottled water dispenser 1100, may comprise a carrying frame 1105 with recessed tie down holes 1110, recessed shoulder strap holes 1115, handles 1120, and handle reliefs 1125. A lid 1130 with lid handle 1135 may be integral to a removable cooler top 1140 which covers a substantial portion of the height of a standard sized (3- or 5-gallon) water bottle. A water guard 1145 is disposed for supporting the standard sized water bottle and allowing water to flow out of the water bottle and into a reservoir 1150 below the water guard 1145. A water dispensing tube 1170 is shown with a tube gasket 1165 and a tube connection nut 1160 for attaching the water dispensing tube 1170 to the reservoir 1150. A dispensing spigot 1180 is shown with a sealing washer 1175 for sealably connecting the spigot 1180 with the dispensing tube 1170 through the cooler base 1185. Reusable blue ice packs 1155 (or similar refreezable packs) may be used for cooling the water held within the reservoir 1150 and dispensed through the water dispensing tube 1170 and spigot 1180. Also, a waste drain 1190 is shown for allowing melted ice, condensation, or other fluids to drain from the cooler base 1185.

Finally, FIG. 12 illustrates a rearward view of a portable bottled water dispenser 1200 with an exemplary carrying frame, according to one embodiment of the invention. As will be appreciated, the rearward view shown illustrates a compact and short profile for the dispenser 1200. The lid portion of a removable cooler top (such as the removable cooler top 1140 in FIG. 11) is shown extending slightly above the top of the carrying frame 1210. This portion may be greater depending upon the size of water bottle used. For example, the portion of the removable cooler top extending above the top of the carrying frame 1210 may be greater when a 5-gallon sized water bottle is used than when a 3-gallon sized water bottle is used. In one embodiment, the only difference between a portable bottled water dispenser 1200 using a 3-gallon sized water bottle and a portable bottled water dispenser using a 5-gallon sized water bottle may be the height of the removable cooler top used. All other components between the two different sized dispensers may be the same. That is, in one embodiment, the cooler base and carrying frame may be used for both 3- and 5-gallon water bottle dispenser configurations with only the removable cooler tops (as differently sized components) lacking interchangeability.

As shown in FIG. 12, the carrying frame 1210 may comprise recessed tie down features 1215 and retractable recessed shoulder straps 1220 which may be recessed within recessed shoulder strap holes 1225. The tie downs 1215 may be used to secure the dispenser to a vehicle utility box (such as those commonly found on road construction or utility trucks), a bench (such as a typical seating bench at a baseball field or other sporting event), chain link fence, or some other structure. For example, the recessed tie down features 1215 may comprise a recessed vertical member to which a standard S-hook may be attached. S-hooks may then be used to strap the dispenser (attached to the carrying frame 1210) to the desired structure.

The shoulder straps 1220 may be used to haul the portable bottled water dispenser (filled or unfilled) from location to location. The shoulder straps 1220 may be retractable so as to retract inward within the carrying frame 1210 (toward the enclosure for the standard sized bottle and other dispenser components). The mechanism for retracting the shoulder straps 1220 may comprise a roller device similar to those used with automobile seat belts. In the retracted position, the shoulder straps 1220 may be completely recessed within the carrying frame 1210 for preventing the straps from catching on obstacles when the portable bottled water dispenser is moved from place to place. In one embodiment, the carrying frame 1210 comprises a slightly contoured but substantially flat backed carrying frame. The back area of the carrying frame 1210 may be slightly contoured for more comfortable carrying using the shoulder straps 1220. Any of a wide variety of materials may be used for constructing the carrying frame 1210. In one embodiment, the carrying frame 1210 may be molded plastic.

As described herein, the present invention provides a portable apparatus for cooling and/or dispensing water using standard three- or five-gallon bottled drinking water, an apparatus for cooling and/or dispensing water using standard three- or five-gallon bottled drinking water integrated into a pickup or vehicle toolbox, an apparatus for actively chilling or heating water dispensed from standard three- or five-gallon bottled drinking water, other embodiments incorporating a compact or short profile dispensing device for receiving drinking water from three- or five-gallon bottled drinking water, and the methods associated with these devices. The present invention, in one embodiment, comprises an apparatus for use with standard sized three- or five-gallon water bottles including a collar for supporting the bottle, a reservoir for receiving water from the bottle, a spigot for dispensing the water from the reservoir, and space around the reservoir that may be filled with ice to cool the water in the reservoir. In one embodiment, the present invention comprises an apparatus for use with standard three- or five-gallon bottles including a collar for supporting the bottle, a reservoir for receiving water from the bottle, a spigot for dispensing the water from the reservoir, and elements thermally contacting the reservoir to heat or chill the water contained therein. In various embodiments, the apparatus comprises a container for enclosing a standard sized bottle, a collar for supporting the bottle, a reservoir for receiving liquid from the bottle, and a spigot for dispensing the liquid from the reservoir.

The terms and expressions which have been employed in the forgoing specification are used therein as terms of description and not of limitation, and there is no intention in the use of such terms and expressions of excluding equivalence of the features shown and described or portions thereof, it being recognized that the scope of the invention is defined and limited only by the claims which follow.

What is claimed is:

1. A compact and short profile portable bottled beverage dispenser for gravitationally dispensing a liquid from an inverted standard sized bottle, the dispenser comprising:

a removable top made of a rigid material and having a height that is greater than or equal to fifty percent of a height of said inverted standard sized bottle so that said removable top may cover fifty percent or more of said height of said inverted standard sized bottle;

a base having a substantially flat bottom surface for maintaining said inverted standard sized bottle in an inverted position and mating surfaces for receiving said removable top, wherein said removable top in combination with said base are capable of fully enclosing said inverted standard sized bottle, and wherein a total height of said dispenser is less than twice said height of said removable top, said total height of said dispenser measured from said substantially flat bottom surface of said base to a top lid surface of said removable top opposite said substantially flat bottom surface;

a collar having an aperture sized to receive a neck portion of said inverted standard sized bottle and disposed within said base for supporting said inverted standard sized bottle in said inverted position;

a reservoir attached to said collar for receiving said liquid from said inverted standard sized bottle, whereby said neck portion of said inverted standard sized bottle extends downward through said aperture of said collar into said reservoir;

a spigot extending from said reservoir for dispensing said liquid from said reservoir;

at least one securing mechanism for holding said removable top to said base and holding said inverted standard sized bottle to said collar so as to minimize leakage when the dispenser is moved; and a space surrounding said reservoir and extending upward in fluid communication with a volume enclosed by said top in combination with said base, wherein ice may be placed within said space surrounding said reservoir so as to cool both liquid within said reservoir and liquid within said inverted standard sized bottle.

2. The dispenser of claim 1, wherein said liquid comprises drinking water.

3. The dispenser of claim 1, wherein said inverted standard sized bottle comprises an inverted three-gallon sized bottle or an inverted five-gallon sized bottle, said bottle of a type commonly used with commercial floor standing bottled water dispensers.

4. The dispenser of claim 1, wherein said removable top includes insulation material for insulating said inverted standard sized bottle from temperature conditions external to said dispenser.

5. The dispenser of claim 1, wherein said removable top comprises an opaque material.

6. The dispenser of claim 1, wherein said collar comprises a water guard of a type commonly used with commercial floor standing bottled water dispensers.

7. The dispenser of claim 1, wherein said reservoir comprises a thermally conductive material, and wherein a coolant placed within said space is capable of cooling both said reservoir and said volume enclosed by said top in combination with said base.

8. The dispenser of claim 1, further comprising at least one active element in thermal contact with said reservoir, said reservoir comprising a thermally conductive material and said active element capable of changing the temperature of said reservoir and said liquid therein.

9. The dispenser of claim 8, wherein said active element comprises a thermoelectric element configured for cooling said reservoir and said liquid therein.

10. The dispenser of claim 8, wherein said active element comprises a thermoelectric element configured for heating said reservoir and said liquid therein.

11. The dispenser of claim 1, further comprising at least one handle disposed on a side of said dispenser for lifting said dispenser to move said dispenser from place to place.

12. The dispenser of claim 1, further comprising a carrying frame attached to said base, wherein said carrying frame comprises at least one handle for lifting said dispenser to move said dispenser from place to place.

13. The dispenser of claim 1, further comprising a carrying frame attached to said base, wherein said carrying frame comprises at least one shoulder strap for lifting said dispenser to move said dispenser from place to place.

14. The dispenser of claim 1, further comprising a carrying frame attached to said base, wherein said carrying frame comprises at least one tie down feature for securing said dispenser to an object.

15. The dispenser of claim 1, further comprising:

a carrying frame attached to said base, said carrying frame comprising at least one handle and at least one shoulder strap for lifting said dispenser to move said dispenser from place to place and at least one tie down feature for securing said dispenser to an object, wherein said liquid comprises drinking water, said inverted standard sized bottle comprises an inverted three- or five-gallon sized bottle of a type commonly used with commercial floor standing bottled water dispensers, said removable top includes insulation material for insulating said inverted standard sized bottle from temperature conditions external to said dispenser, said removable top comprises an opaque material, and said collar comprises a water guard of a type commonly used with a commercial floor standing bottled water dispensers.

16. A method of using a compact and short profile portable bottled beverage dispenser for gravitationally dispensing a liquid from an inverted standard sized bottle, the method comprising:

closing a removable top made of a rigid material and having a height that is greater than or equal to fifty percent of a height of said inverted standard sized bottle so that said removable top may cover fifty percent or more of said height of said inverted standard sized bottle over a space containing said inverted standard sized bottle;

maintaining said inverted standard sized bottle in an inverted position using said removable top and a base having a substantially flat bottom surface, wherein said removable top in combination with said base fully enclose said inverted standard sized bottle, and wherein a total height of said dispenser is less than twice said height of said removable top, said total height of said dispenser measured from said substantially flat bottom surface of said base to a top lid surface of said removable top opposite said substantially flat bottom surface;

supporting said standard sized water bottle with a collar having an aperture sized to receive a neck portion of said inverted standard sized bottle and disposed within said base;

receiving said liquid from said inverted standard sized bottle into a reservoir attached to said collar, whereby said neck portion of said inverted standard sized bottle extends downward through said aperture of said collar into said reservoir; and dispensing liquid from said reservoir through a spigot extending from said reservoir, wherein said dispenser includes at least one securing mechanism for holding said removable top to said base and holding said inverted standard sized bottle to said collar so as to minimize leakage when the dispenser is moved, and said dispenser further includes a space surrounding said reservoir and extending upward in fluid communication with a volume enclosed by said top in combination with said base, wherein ice may be placed within said space surrounding said reservoir so as to cool both liquid within said reservoir and liquid within said inverted standard sized bottle.

17. The method of claim 16, wherein said liquid comprises drinking water.

18. The method of claim 16, wherein said inverted standard sized bottle comprises an inverted three-gallon sized bottle or an inverted five-gallon sized bottle, said bottle of a type commonly used with commercial floor standing bottled water dispensers.

19. The method of claim 16, wherein said dispenser further comprises:

a carrying frame attached to said base, said carrying frame comprising at least one handle and at least one shoulder strap for lifting said dispenser to move said dispenser from place to place and at least one tie down feature for securing said dispenser to an object, further wherein said liquid comprises drinking water, said inverted standard sized bottle comprises an inverted three- or five-gallon sized bottle of a type commonly used with commercial floor standing bottled water dispensers, said removable top includes insulation material for insulating said inverted standard sized bottle from temperature conditions external to said dispenser, said removable top comprises an opaque material, and said collar comprises a water guard of a type commonly used with commercial floor standing bottled water dispensers.

* * * * *